United States Patent [19]

Brown et al.

[11] 3,952,839

[45] Apr. 27, 1976

[54] RAIL TRACKWAY FITTED WITH BRAKING DEVICES

[75] Inventors: Patrick R. Brown, Zumikon; Max A. Buehler, Thalwil, both of Switzerland

[73] Assignee: Weelpal, A. G., Zug, Switzerland

[22] Filed: Dec. 19, 1974

[21] Appl. No.: 534,413

[30] Foreign Application Priority Data

Dec. 20, 1973 Switzerland ..... 18118/73
July 18, 1974 Switzerland ..... 10025/74

[52] U.S. Cl. ..... 188/62; 104/26 A; 238/129; 238/148

[51] Int. Cl.[2] ..... B61K 7/02

[58] Field of Search ..... 238/129, 148, 150, 382; 188/36, 62; 104/1 R, 26 R, 26 A, 162, 249

[56] References Cited

UNITED STATES PATENTS

| | | | |
|---|---|---|---|
| 206,738 | 8/1878 | Leypoldt | 238/148 |
| 3,439,778 | 4/1969 | Garbers et al. | 188/62 |
| 3,633,710 | 1/1972 | Preinfalk | 188/62 |

FOREIGN PATENTS OR APPLICATIONS

| | | | |
|---|---|---|---|
| 272,785 | 6/1927 | United Kingdom | 188/62 |

*Primary Examiner*—Robert J. Spar
*Assistant Examiner*—Randolph A. Reese
*Attorney, Agent, or Firm*—Abraham A. Saffitz

[57] ABSTRACT

A rail trackway fitted with braking devices which are arranged along predetermined intervals and comprise elastically deformable braking bodies adapted for use in warehouses and at loading stations for transshipment.

8 Claims, 12 Drawing Figures

RAIL TRACKWAY FITTED WITH BRAKING DEVICES

CROSS-REFERENCE TO RELATED APPLICATIONS

Applicants call attention to their Swiss Patent Application No. 18118/73, filed Dec. 20, 1973 and their Swiss Patent Application No. 10,025/74, filed July 18, 1974 and priority is claimed under 35 USC 119.

BACKGROUND OF THE INVENTION

1. Field of the Invention

The present invention relates to a rail trackway fitted with braking devices which are arranged along predetermined intervals and comprise elastically deformable braking bodies.

2. Description of the Prior Art

Heretofore, rail vehicles on trackways have been used for the warehousing of and for the transshipment of goods at transloading stations and in warehouses. There are frequently used railway vehicles on inclined trackways and these vehicles are switched, pulled, or pushed on the trackway. When it happens that railway vehicles, which are not driven or which are not permanently attached to a driving vehicle fitted with brake devices and which are used on a rail trackway which has a certain gradient, it is necessary to use braking devices on the trackway to control the rail vehicle movement. In this manner, the prior art has recognized the need to keep the speed of these railway vehicles within certain limits. The gradient of the trackway is usually selected to be at least as large as will provide, in all circumstances, a safe and automatic rolling from a resting condition when the brake is released and that this rolling will occur irrespective of whether the railway vehicle is heavily loaded, lightly loaded, or empty. However, when a severe or very steep gradient is used, this brings about an acceleration of the railway vehicle to such a speed which goes beyond a tolerated limit and the prior art has recognized the need to brake the railway vehicles.

For deceleration of railway vehicles, the prior art has used large-scale, expensive friction brakes, electric brakes, and hydraulic brakes, all of which are relatively susceptible to breakdowns and all of which are high in initial costs or maintenance.

It has also been proposed in the prior art to arrange under the running surface of the rail trackway, elastically deformable braking bodies which have an upper attachment and which bodies project through a slot partially into the trackway. This attachment is run over by the vehicles, and the elastic brake body thus deforms, whereby the vehicles are decelerated.

OBJECT OF THE INVENTION

This principle of the braking has proved itself very well, and it is the object of the present invention to improve the construction of the rail trackway, the specific arrangement of the braking bodies, to lower the cost, and to simplify the construction.

SUMMARY OF THE INVENTION

In accordance with the invention this object is achieved in a rail trackway of the inclined type mentioned hereinbefore, in constructing the elastic braking bodies in the form of beads, mounted onto the trackway and projecting in the unloaded state beyond the surface of the trackway whereby the elastic material having a high inherent damping serves to decelerate the railway vehicle moving along the trackway.

The high inherent self damping characteristic of the braking body is coupled with a pronounced elastic hysteresis behavior, and these characteristics make possible, in the simplest manner, the withdrawal of kinetic energy from the railway vehicle, while it is rolling over the braking device, to a precisely predetermined extent. These braking devices of the invention operate in a completely maintenance-free and reliable manner and can be installed at low cost.

In accordance with the invention, one may vary the braking action by the deformable beads by using the same braking bodies and having the upper part thereof, projecting out of the surface of the trackway, and by having each braking body installed in the trackway asymmetrically along its entire length with regard to a longitudinal central plane placed through the braking body.

BRIEF DESCRIPTION OF THE DRAWINGS

Exemplified embodiments of the rail trackway of the invention will be explained in more detail hereinunder, with reference to the enclosed drawings, in which.

DESCRIPTION OF THE PREFERRED EMBODIMENTS

Figure 1:
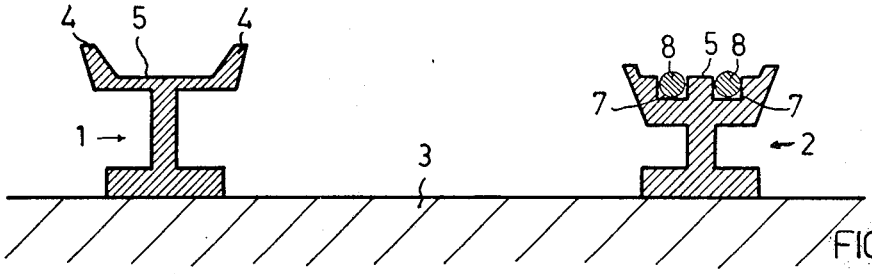
FIG. 1 shows a cross-section of a first embodiment of a rail trackway in accordance with the invention at a location which is provided with a braking device in the unloaded state.
Figure 2:
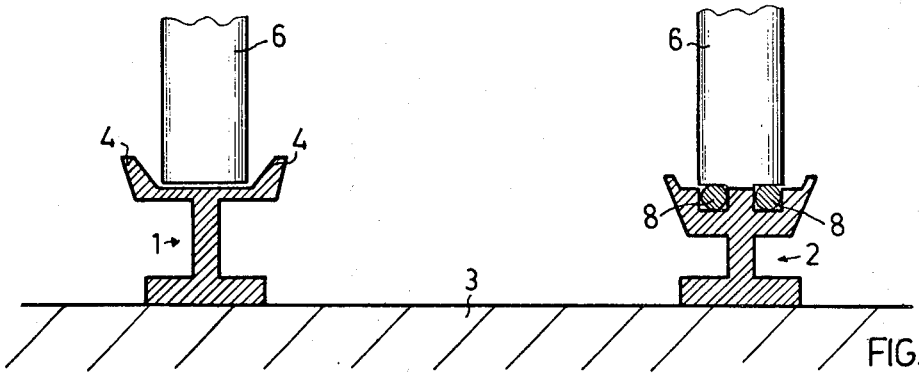
FIG. 2 shows the embodiment of FIG. 1 which is in the loaded state.
Figure 3:
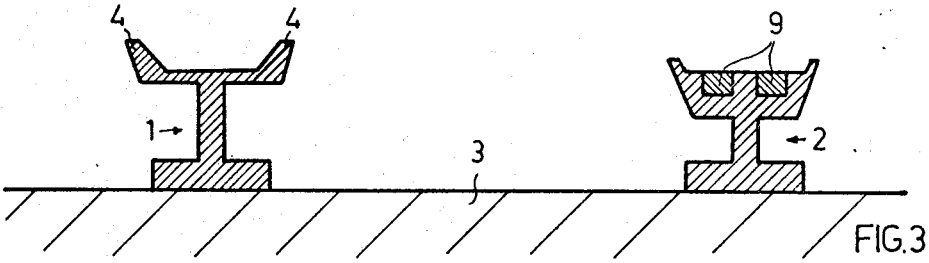
FIG. 3 shows a cross-section through the rail trackway in accordance with FIGS. 1 and 2 but at a location not having a braking device.

As is shown in FIGS. 1 to 3, the rail trackway has a lefthand rail 1 and a righthand rail 2, which are mounted on a suitable substratum 3 with the aid of fastening means which are not shown in detail. The lefthand rail 1 has two lateral borders or rims 4 which extend along its edges and which serve for the guidance of a wheel 6 running on the surface 5 of the trackway. The righthand rail 2 has two longitudinally-extending groove-like channels 7 which are provided with the trackway 5, symmetrically to its central line. Inserted into these channels 7 at specific intervals are bead-like braking bodies 8. As is clearly seen in FIG. 1, these braking bodies 8 project somewhat beyond the trackway surface 5.

When a vehicle rolls with its wheels 6 over such a location, the braking bodies 8 are deformed and pressed into the channels 7. This state is shown in FIG. 2.

At those locations of the trackway where no braking bodies 8 are inserted into the channels, the latter can be closed with their profiles 9 arranged to profile a greater bearing surface for the wheels 6 of the vehicles.

Figure 4:
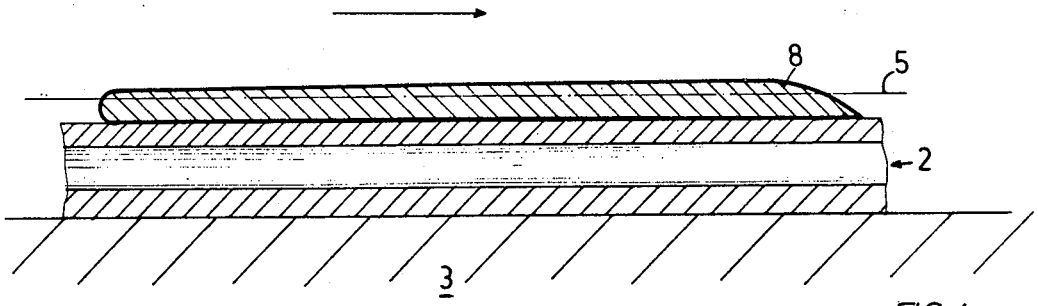
FIG. 4 shows a longitudinal section through a part of the rail trackway in accordance with FIG. 1.
Figure 5:
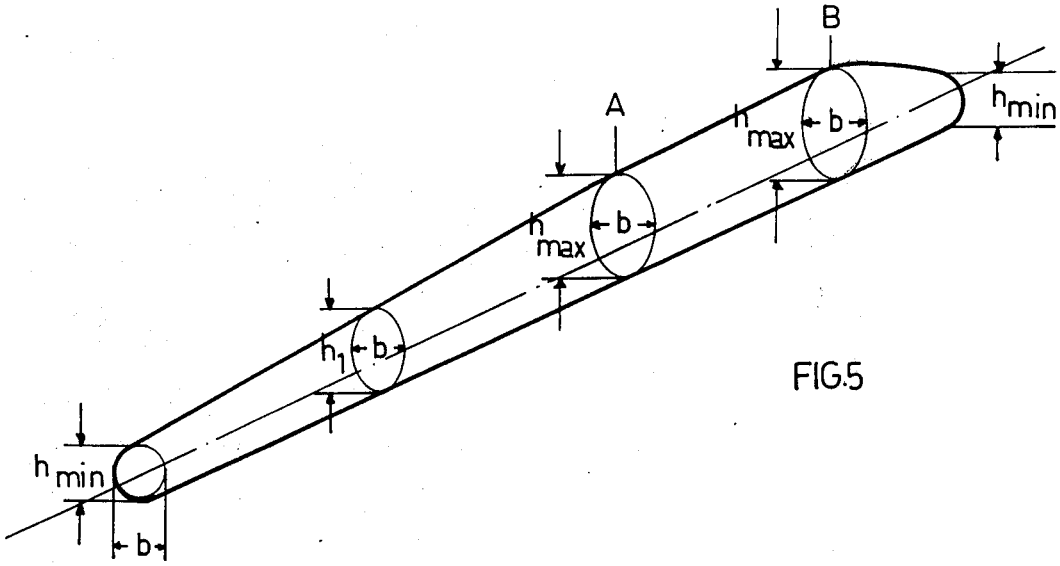
FIG. 5 shows a perspective view of the embodiment of the braking body of FIG. 1.

The shape of the braking bodies 8 is seen in FIGS. 4 and 5. While their width $b$ is at all times constant at any point along their entire length, their height increases from a minimum value $h_{min}$ which can for example be the same as $b$, initially, steadily over $h_1$ up to a maximum value $h_{max}$ at the location A, remains constant as far as the location B and then decreases along the final small portion of the braking body 8 rapidly to the minimum value $h_{min}$.

It is advantageous if $h_{min}$ corresponds approximately to the depth of the channels 7, as is shown in FIG. 4. In this FIG. 4, the broken line indicates the surface of the trackway, and it can clearly be seen that the braking body 8 in the trackway, considered in the direction of the arrow, forms a ramp which has to be overcome by the wheel 6 of the vehicle.

Figure 6:
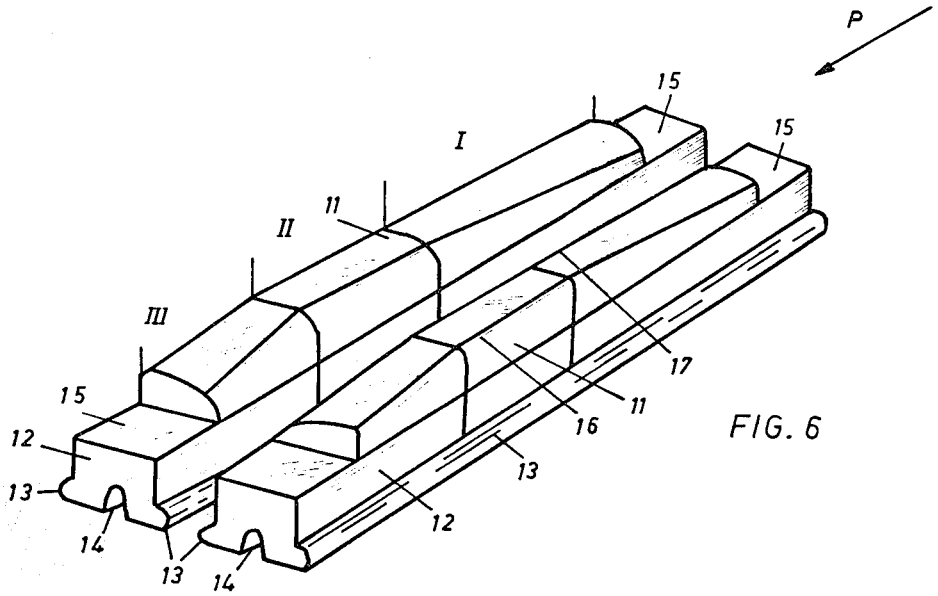
FIG. 6 shows a perspective view of two braking bodies which are designed in a mirror-inverted relation and represents a second embodiment of the invention.
Figure 7:
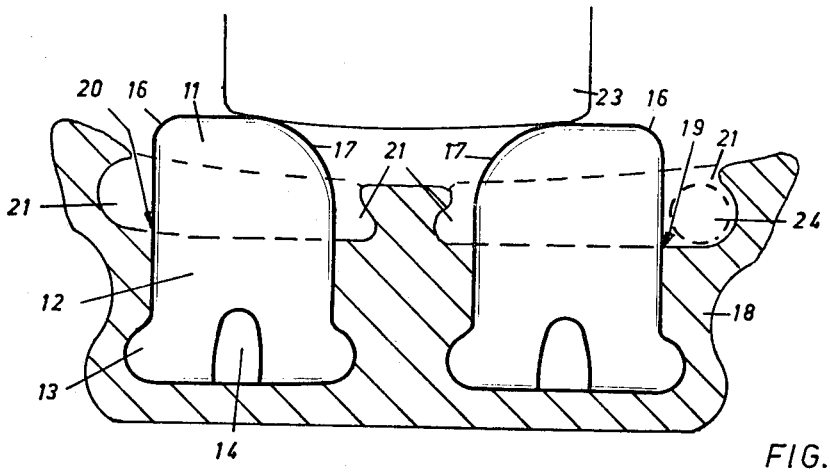
FIG. 7 and 8 show a cross-section through a rail of a rail trackway having braking bodies in accordance with FIG. 6.
Figure 8:
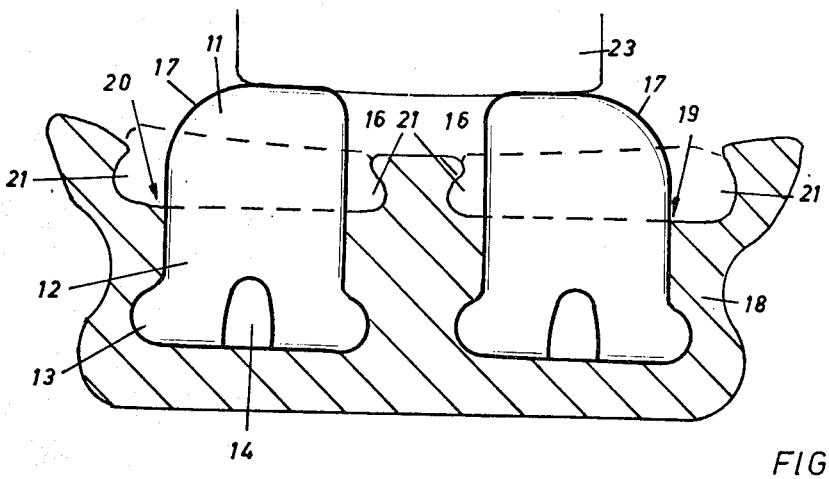

Another embodiment of the invention is seen in FIGS. 6 to 8. Each of the braking bodies, in this case, is divided into an upper part 11 and a lower part 12. The lower part 12 has a substantially rectangular cross-section and arranged along the lower edges of both of the side surfaces there are provided longitudinally extending extensions 13. Situated on the lower surface in the center is a groove-like depression 14 which likewise extends longitudinally. Superimposed onto the lower part 12, but designed in one piece therewith, is the upper part 11, which is much shorter dimensioned so that shoulders 15 are formed at both ends of the braking body. The upper part 11, like the lower part 12, has a substantially rectangular cross-section, but the two upper edges 16 and 17 are rounded off with a different radius. While the height of the lower part 12 is approximately the same at each point of the braking body, the upper part 11 has a gently rising section I, a section II having a constant height and a steeply declining section III. The arrow P in FIG. 6 indicates in this respect the direction of movement of a vehicle rolling over the braking body.

Shown in FIGS. 7 and 8 are two variants of the incorporation of a braking body pair into a rail of a rail trackway. The rail is designated as a whole by 18 and has two groove-like channels 19 and 20, which receive the braking bodies. The lower parts 12 of the same are in this connection completely enclosed by the rail, in which connection the lateral extensions 13 of each braking body lower part 12 are received in corresponding grooves at the bottom in the groove-like channels 19 and 20. In this way a firm seat of the braking bodies in the rail is ensured, and the depression 14 allows a pressing-together and compression of the lower part 12, so that the insertion of the braking bodies is facilitated.

Present on both sides of the upper part 11 of the braking bodies are recesses 21, which allow a yielding of the upper part 11 deformed elastically upon the overrunning of the braking body. At the same time, these recesses serve to support cover strips 22 for the channels 19 and 20, namely at those points where no braking bodies are incorporated.

It can clearly be seen from FIGS. 7 and 8 that the upper part 11 of each braking body is asymmetric in design. The basic shape of this upper part 11 is in cross-section a rectangle, the upper two corners of which are rounded off with a different radius. The ratio of the rounding radii is about 1 : 3. A pair of braking bodies incorporated side by side into the rail 18 consists respectively of two bodies fashioned in mirror-inverted relation. In FIG. 7 the more severely rounded upper edges 17 lie adjacently, i.e. towards the center of the rail, while in FIG. 8 a reversed arrangement is to be found. Since substantially only somewhat more than half the width of the braking bodies is run over by the wheel 23 of the wagon (vehicle), it is obvious that in the case of an arrangement in accordance with FIG. 7 a lesser braking action occurs than in the case of an arrangement in accordance with FIG. 8. By this means, it is achieved that with a single pair of braking bodies formed in mirror-inverted relation, depending on incorporation, a stronger or a weaker braking action can be achieved, as desired.

It has proved to be advantageous if about 10 – 30% of the braking body height projects beyond the surface of the rail to be engaged by the vehicle, this being measured at the highest point, namely, in the section II.

Figure 9:
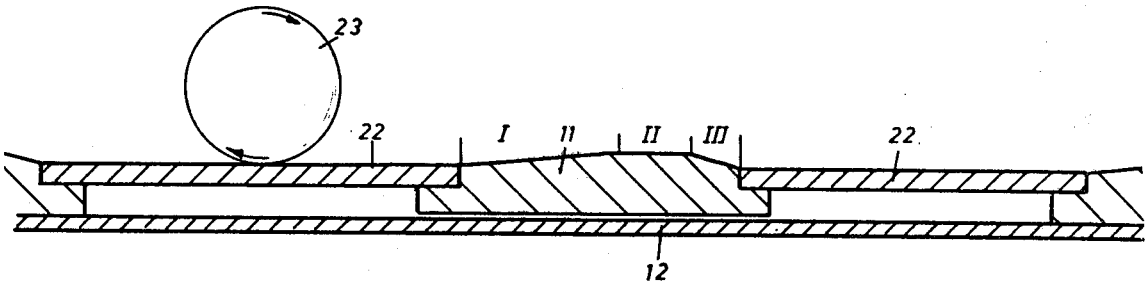
FIG. 9 shows a schematic longitudinal section through a rail of the rail trackway in accordance with FIGS. 7 and 8.
Figure 10:
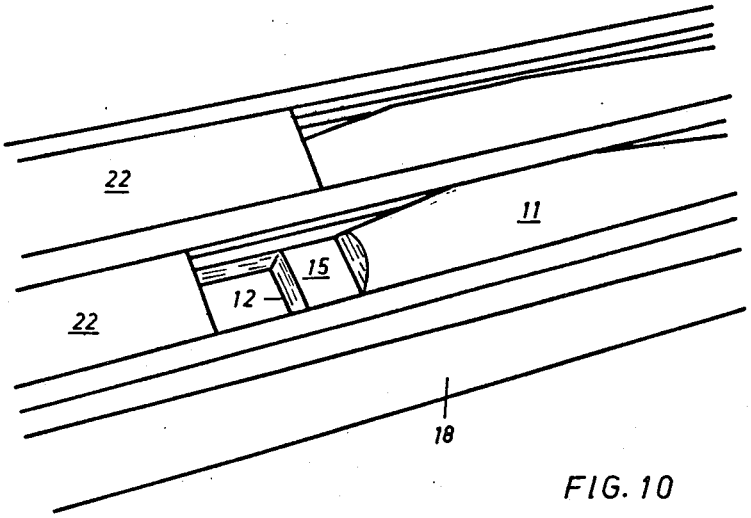
FIG. 10 shows a perspective and a top plan view of a section which is a cutout detail of a rail for a rail trackway in accordance with FIGS. 7 and 8.

In FIGS. 9 and 10, it is seen how the cover plates 22 additionally serve for the fixing engagement of the braking bodies in the rail 18. The shoulders 15 have the purpose of providing a bearing support surface for the ends of the cover plates 22, so that the braking bodies are fixed both in the horizontal direction along the rail, namely by butting against the front end surfaces of the upper parts 11 and in the vertical direction. In FIG. 10, for better comprehension, one of the cover plates 22 is shown somewhat shifted, so that its relative position to the shoulders 15 on the braking bodies can be perceived.

The braking bodies can consist, for example, of natural or synthetic rubber having high damping, and a preferred example is butyl rubber. This material has a very great inherent damping with a pronounced hysteresis behavior, and thus makes it possible, upon the run-past of a vehicle, to withdraw from this latter a certain amount of kinetic energy. Through the high inherent damping, this removed energy is converted virtually completely into heat.

Figure 12:
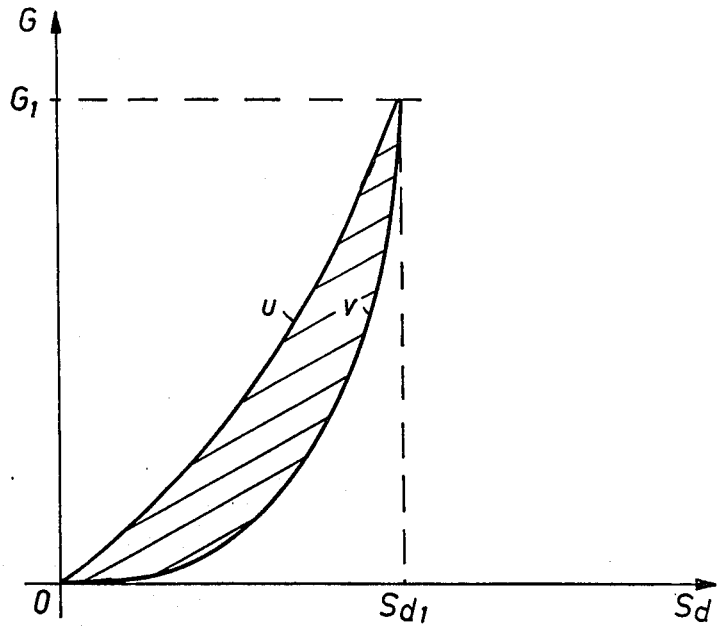
FIG. 12 shows a diagram of the behavior of the braking bodies under compressive pressure loading.

The behavior of this material under the action of a compressive force is shown in FIG. 12.

While on the vertical axis of the diagram the compressive force G is entered which is exerted by the wheels of a vehicle rolling thereover, the horizontal axis gives a dimension for the deformation $s_d$ under the action of G. The curve $u$ shows the behavior of the braking body upon the rise of the compressive force from 0 to $G_1$, where a maximum deformation $s_{d1}$ is achieved. The curve $v$, on the other hand, shows the behavior with decreasing compressive force from $G_1$ to 0. The hatched area enclosed by the two curves $u$ and $v$ indicates a dimension for the amount of energy absorbed by the braking body.

Figure 11:
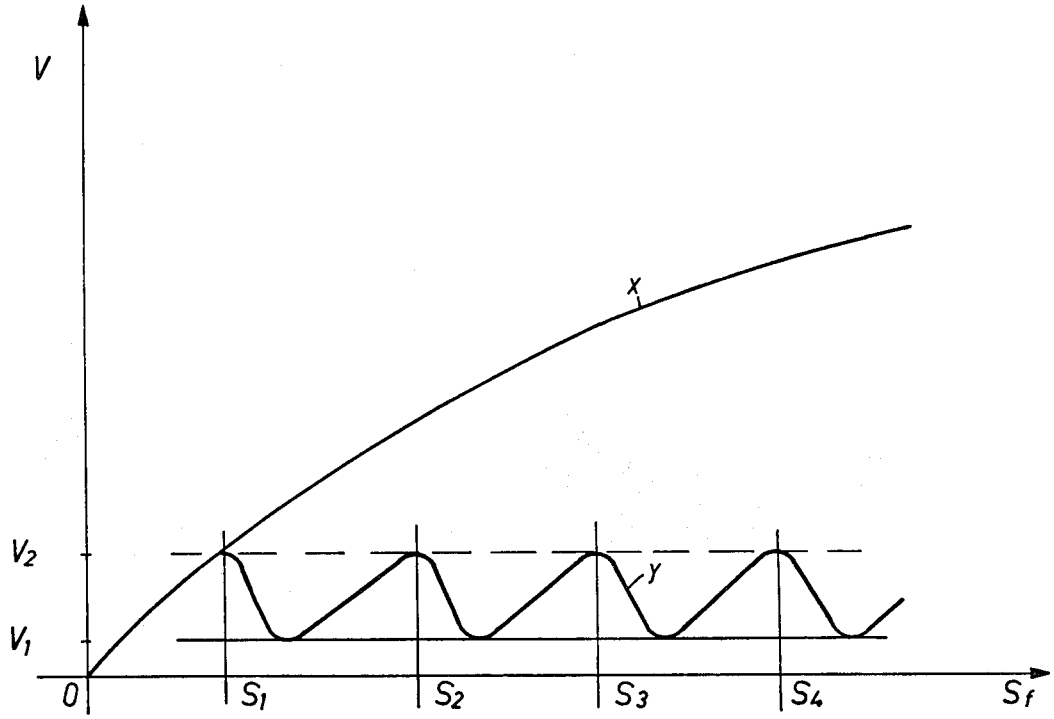
FIG. 11 shows a diagram of the speed course of a railway vehicle.

Shown in FIG. 11 is a speed diagram. The vertical axis indicates the speed of a vehicle moving on such an inclined rail trackway, while the horizontal axis is associated with the length of path covered. The curve $x$ applies to a freely rolling vehicle. It can be seen that the speed increases on and on, up to a value where the risk of derailment or danger for the loaded goods exists. The curve $y$ shows, on the other hand, the speed course of a vehicle on a rail trackway in accordance with the invention.

This is equipped at the points $s_1$, $s_2$, $s_3$, $s_4$, and so forth with respectively a braking device, so that the speed of the vehicle rolling thereon always oscillates between a maximum speed $v_2$ and a minimum speed $v_1$. These two speeds must, of course, be adapted to the individual factors, which takes place through expedient selection of the position within the trackway, through the length of the braking bodies and through the height thereof.

What is claimed is:

1. In combination, a rail trackway provided with braking devices which are arranged at predetermined intervals and consist of elastically deformable braking bodies, the improvement comprising:

said braking devices in the form of beads which are inserted into the trackway and which project in the unloaded state beyond the surface of said trackway and being made of elastic material having high inherent damping;

receiving means along one of the rails of said rail trackway comprising two parallel extending groove-like channels, for the reception of the braking bodies; and, the lower part of said braking body which sits in the track being symmetrical and having along its lower edges a longitudinally extending and laterally projecting extension.

2. The combination as claimed in claim 1 wherein said braking devices consist of butyl rubber.

3. The combination as claimed in claim 1, wherein the lower part of the braking device is provided at its lower surface with a groove-like depression extending along its length.

4. The combination as claimed in claim 1 comprising two braking devices in mirror-inverted relation which are arranged in the two channels at predetermined intervals and side by side.

5. The combination as claimed in claim 4, wherein the braking devices are arranged side by side with their upper edges having a smaller rounding radius lying adjacent to one another in order to achieve a strong braking action.

6. The combination as claimed in claim 4, wherein the braking devices are arranged side by side with their upper edges having a greater rounding radius lying adjacent to one another to achieve a low braking action.

7. The combination as claimed in claim 1, wherein the channels are sealed at points not having a braking device by inserting a profile member.

8. The combination as claimed in claim 1 wherein the upper part of said braking devices projects at least partially out of the surface of the track and is asymmetric along its entire length relative to a vertical longitudinal central plane passing through the braking device.

* * * * *